United States Patent [19]

Dyllus et al.

[11] 4,134,559

[45] Jan. 16, 1979

[54] EQUIPMENT FOR PROCESSING MATERIAL IN SHEET OR RIBBON FORM

[75] Inventors: Frank-Ulrich Dyllus; Hans Kaulen, both of Grevenbroich; Manfred Schmidt, Jüchen, all of Fed. Rep. of Germany

[73] Assignee: VAW-Leichtmetall GmbH, Bonn, Fed. Rep. of Germany

[21] Appl. No.: 788,415

[22] Filed: Apr. 18, 1977

[30] Foreign Application Priority Data

Apr. 17, 1976 [DE] Fed. Rep. of Germany ..... 2617090

[51] Int. Cl.[2] ..... B21C 47/02

[52] U.S. Cl. ..... 242/78.1; 226/119; 242/55

[58] Field of Search ..... 242/78.1, 80, 55.01, 242/58, 58.1; 226/119, 113

[56] References Cited

U.S. PATENT DOCUMENTS

| | | | |
|---|---|---|---|
| 2,797,089 | 6/1957 | Lorig | 226/119 |
| 3,219,289 | 11/1965 | Alexeff et al. | 242/55.01 |

FOREIGN PATENT DOCUMENTS

| | | | |
|---|---|---|---|
| 730033 | 3/1966 | Canada | 242/55 |

*Primary Examiner*—George F. Mautz
*Attorney, Agent, or Firm*—Darby & Darby

[57] ABSTRACT

An apparatus is provided for continuously processing metal ribbon from ribbon spools of fixed capacity to form spools of processed ribbon. At a dispensing or wind-out reel a continuous metal ribbon is formed by alternately emptying spools from two different positions, joining the ribbon from alternately emptied spools, and replacing each empty spool with a full one while the other spool is being emptied. The continuous metal ribbon is provided to a processing station and, from there, is delivered to a collecting or wind-up reel where a pair of spools are alternately filled with processed ribbon and a full spool is replaced with an empty one while the other spool is being filled. A festoon tower provides a pair of elongated paths of independently variable travel length for ribbon moving, respectively, between the dispensing reel and processing station and between the processing station and collecting reel. This tower provides a continuous movement of ribbon to and from the processing station. One tower path normally stores a predetermined amount of the continuous ribbon and releases the stored ribbon to the processing station during transferring and spool-changing operations at the dispensing reel, thereby providing a supply of ribbon to the processing station during these operations. The other tower path stores ribbon from the processing station only during the transferring and spool-changing operation at the collecting reel and releases the stored ribbon to the collecting reel thereafter, thereby guaranteeing a continuous withdrawal of ribbon from the processing station during these operations.

6 Claims, 6 Drawing Figures

EQUIPMENT FOR PROCESSING MATERIAL IN SHEET OR RIBBON FORM

The invention relates to equipment for processing material in sheet form, especially metal ribbon, and particularly concerns such equipment which includes a dispensing or wind-off reel, a treating zone, a collecting or wind-up reel and a festoon or sling-tower connected in series either before or after the processing zone.

In equipment for treating paper or the like, for example rotary presses and coating machines, it is possible to change spools of material on the fly and thereby to avoid interrupting the process. However, the properties of other flat materials, especially metal ribbon, do not permit a run-down spool on conventional reels to be replaced by a new spool at the speed that the sheet or web has in the processing station of the equipment. Nor is it possible, with such materials, to remove the fully wound-up spool at the end of the equipment and immediately to commence winding-up onto a new spool the sheet or web coming out of the processing zone.

In order to avoid an interruption to the operation, it is well known in the art that a so-called sling tower may be provided at the beginning and at the end of such processing equipment. The sling tower is designed to take up a variable length of material in sheet form and thereby acts as buffer for a certain time. Typically, the capacity of the sling tower must be sufficiently great, so as to bridge the normal duration of an exchange of spools.

The known sling towers are space-consuming, which, since they are required in pairs, becomes disturbingly noticeable, especially when a rather compact construction of the processing equipment is aimed for.

For storing and exchanging spools of material, high-shelf systems have recently been successful. In such systems, large amounts of material can be accommodated on a minimum of floor surface and, preferably by using computer-controlled elevators, these systems enable spools to be transported in and out. It is necessary, however, that the spools in the delivery or receiving stations lie approximately in a vertical plane next to or over one another. At the same time, the shortest possible paths between wind-up and wind-off stations are to be provided, in order to reduce investment costs and access times. For this reason, processing equipment in which the two sling towers are next to one another, are unsatisfactory.

The invention accomplishes the object of providing processing equipment of the type mentioned above, which has a reduced space requirement and in which the wind-up and wind-off stations lie in a vertical plane in close proximity. By these means, the transport processes required for exchanging spools can be kept to a minimum. In particular, it is possible to wind off the ribbons from the high-shelf storage, and, after passing them through the processing equipment, to wind them up again in the high-shelf storage, without having to transport the coils of the material within the production area.

The inventive equipment is characterized by the fact that the sling tower has two rows of stationary guide rollers at opposite ends of a frame construction and two sling carriages, which can travel from one end to the other. Each carriage has a second series of rollers associated with the first series of rollers, whereby the rollers can alernatively be looped by the ribbon of material.

Further advantages and characteristics of the invention will be evident from the following description and the accompanying claims.

In the following, the invention is explained and represented by way of example by means of the drawing, in which:

FIG. 1 is considered first. This illustrates the construction and the method of operation of the inventive equipment.

Figure 1:
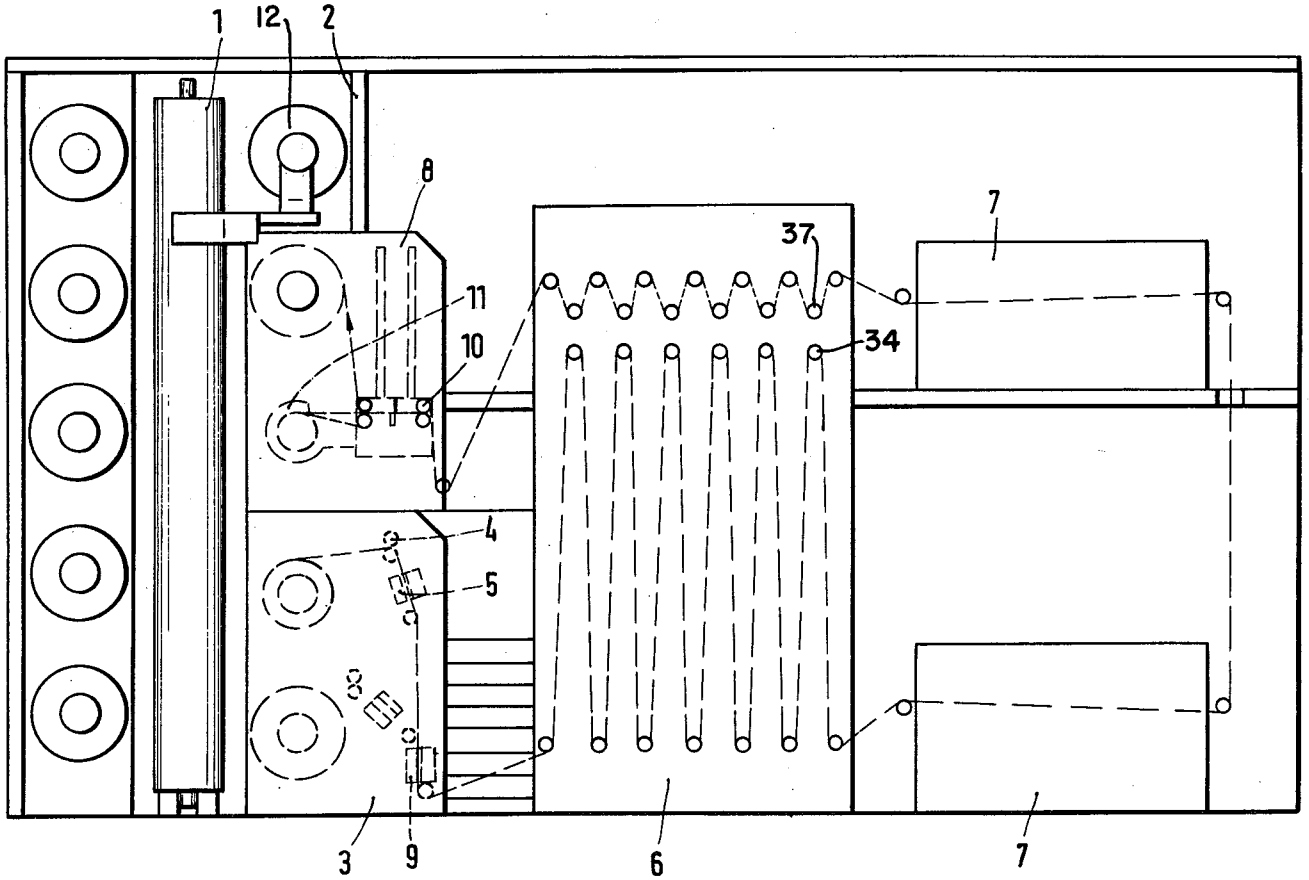
FIG. 1 is a schematic side elevation of the inventive equipment.

A shelf elevator 1 transports a full spool 12 from a high-shelf magazine 2 to a first of two wind-off positions of a double wind-off reel 3 in the magazine, and places it on prism supports (not shown) which are fastened to the wall of the magazine. Two reel cones grip the spool and lift it out of the prism supports. By means of an auxiliary drive, the marked start of the spool ribbon is turned into a fixed position, so that a conventional drawing-in device (not shown) can pick up the start of the ribbon. After the steel tape around the spool has been cut, the drawing-in device transports the start of the ribbon and the steel tape to a driver 4. The steel tape is removed manually and the start of the ribbon is conveyed to cropping shears 5 by means of a driver and an auxiliary drive on the reel. The start of the ribbon is cropped here and conveyed to a jointing device 9. These procedures, which may be described as ribbon preparation, are carried out while the ribbon of the second wind-off position of the reel is running over a sling tower 6 (which must fulfill a double function), through processing equipment 7, and again over the previously mentioned sling tower 6 to the double wind-up reel 8.

On changing ribbons, the lower sling carriage 34 in sling tower 6 is lowered and delivers a stored supply of ribbon to the processing machine 7. In the meantime, the wind-off reel 3 stops and the jointing device 9 connects the previously prepared start of the ribbon with the end of the ribbon that has run off. After the start of the ribbon has been joined to the end of the run off ribbon, the ribbon of the first wind-off position of reel 3 is wound off and the empty winding spool is transported by the shelf elevator 1 from the second winding position into the high-shelf magazine 2. The shelf elevator 1 can now deposit a fresh full spool into the winding-off position, which has become vacant.

After the ribbon with the joint has passed through the equipment and has arrived at the double wind-up reel 8, the exchange of ribbon commences at the wind-up reel 8. This exchange of ribbons is operative through associated electrical or mechanical control apparatus to initiate the downward movement of upper sling carriage 37 in the sling tower 6 thus storing in the sling tower rollers the supply of ribbon coming from the processing machine 7 and from the wind-off reel 3. While the above-mentioned equipment can continue to run with undiminished speed, wind-up reel 8 stops. The ribbon is divided crosswise and the new start of the ribbon is wound onto the second wind-up position of the double wind-up reel 8 by means of driver 10 and belt looper 11. After ribbon exchange has been effected, upper sling carriage 37 again drives to its upper position and delivers the stored supply of ribbon to the winding-up device 8. Shortly before the ribbon exchange, lower sling carriage 34 drives to the wind-off reel 3, also in its upper position, and so stores a supply of ribbon for the next ribbon exchange.

A shelf elevator 1 in the meantime transports the finished wound spool from the wind-up position in reel 8 into the high-shelf magazine 2 and brings an empty wind-up spool to the position in the wind-up reel 8, which has become vacant, where it is gripped by means of the reel cones.

Figure 2:
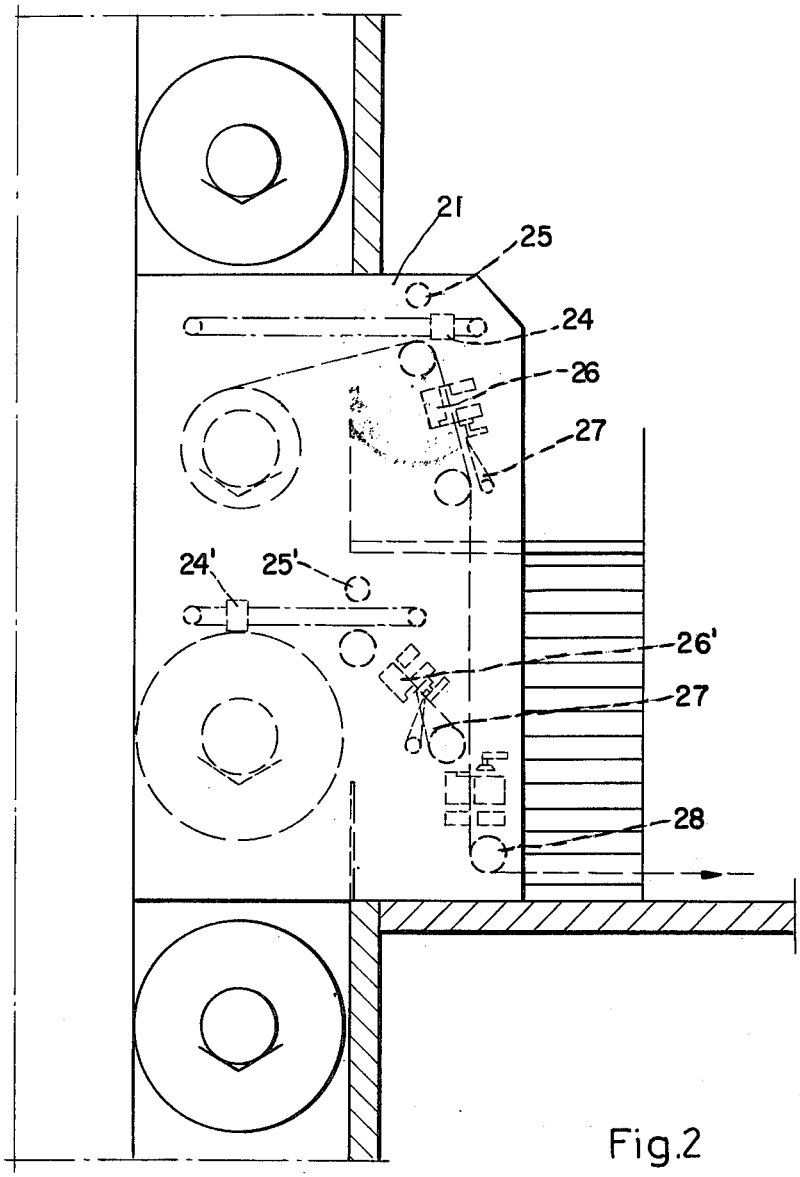
FIG. 2 is a side view on an enlarged scale, of the double wind-off reel of the equipment of FIG. 1.
Figure 3:
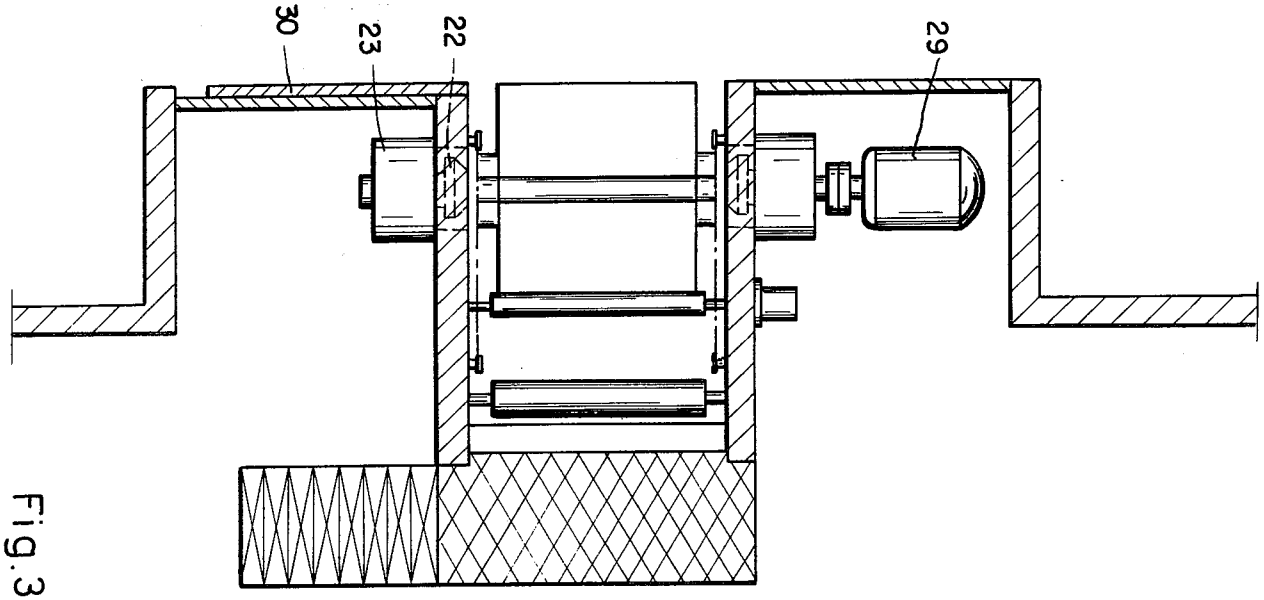
FIG. 3 is a section, taken through the double wind-off reel of FIG. 2, showing it in detail as seen from above.

The above-mentioned double wind-off reel is shown in greater detail in FIGS. 2 and 3.

FIG. 2 is a front view and FIG. 3 a top view section through the reel. The side stands 21 (FIG. 2), which take up the gripping cones 22 (FIG. 3) and their guides 23 (FIG. 3) are a part of the support wall in the high-shelf magazine. A linear motor, a vacuum or magnetic beam with built-in nipple shears 24 (FIG. 2), cuts the tape around the spool and transports the start of the ribbon to the driver 25 (FIG. 2). The driver conveys the start of the ribbon into the ribbon-preparation station 26 (FIG. 2), which consists of a clamping beam, an adhesive-tape dispenser and cropping shears. The cropped end of the ribbon is passed over a scrap sewer 27 (FIG. 2) into a container. The start of the ribbon, which has been prepared for jointing with the end of the ribbon that is running down, is transported by driver 25 to the gluing press 28 (FIG. 2). The gluing press consists of a clamping beam, a pressing beam and cropping shears. The cropping shears cut through the end of the ribbon that is running down, whereby the clamping beam previously holds fast the end of the ribbon and the start of the ribbon press 28 (FIG. 2) is joined to the end of the ribbon. The spools that are running down are braked by a direct-current generator 29 (FIG. 3) which can be selectively switched from one wind-off position to the other. For purpose of repair, slidable bulkhead wall 30 (FIG. 3) closes off the reel space from the high-shelf magazine.

Figure 4:
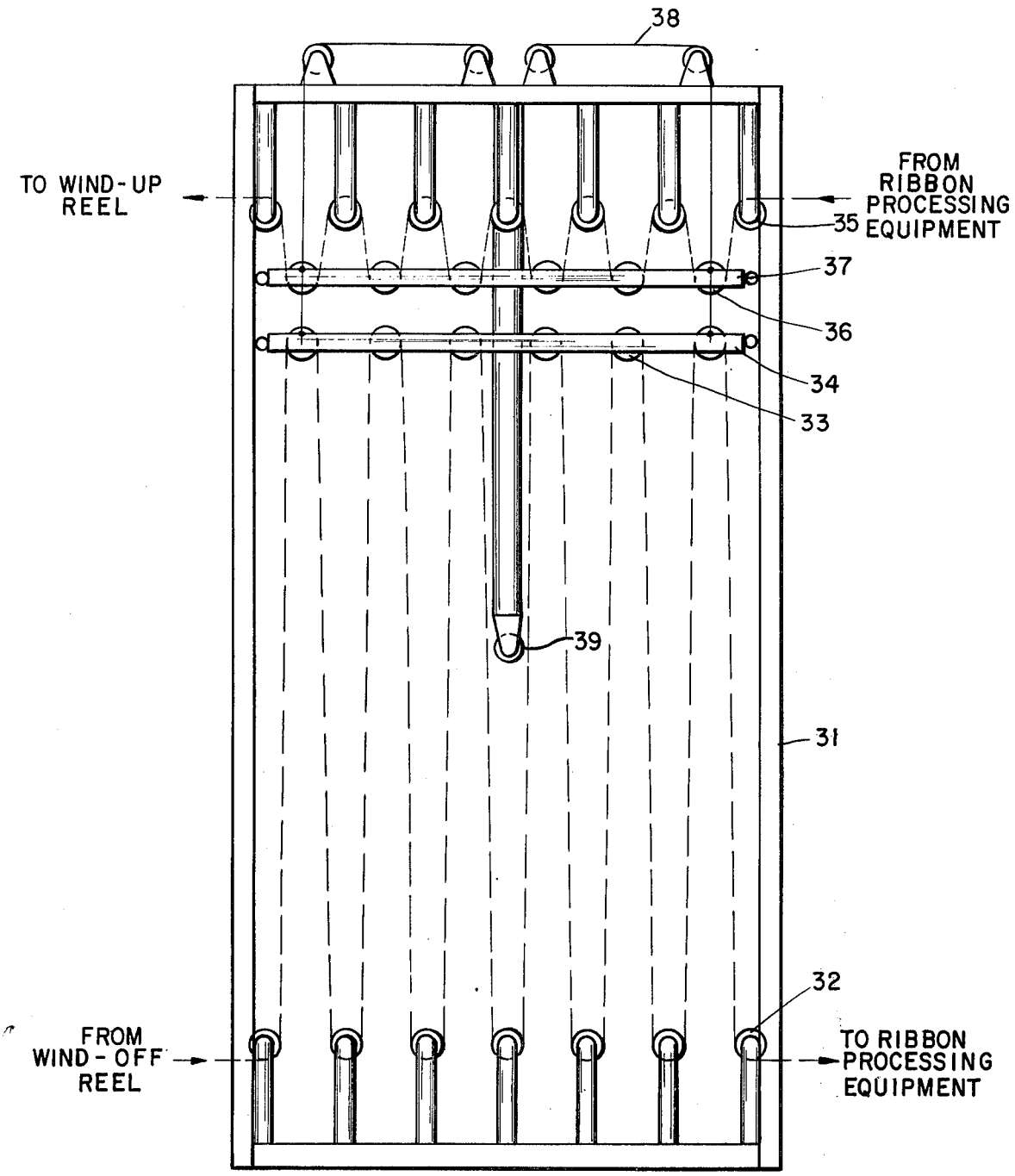
FIG. 4 is a schematic side elevation, on an enlarged scale, of the sling tower.

FIG. 4 shows the details of the sling tower, which is a significant component of the inventive equipment.

Sling towers (sometimes referred to as festooner arrangements) or ribbon stores are used today wherever ribbon processing machines must run continuously, even during ribbon exchange.

Contrary to conventional construction, the sling tower, shown in FIG. 4 has two sling carriage instead of one and is therefore particularly suitable for assembly in processing equipment constructed in tiers.

The sling tower consists of a frame construction 31, and a row of stationary guide rollers 32 which are connected via the ribbon material with the rollers 33 of the lower sling carriage 34. In the upper portion of the sling tower, a number of statinary guide rollers 35 are connected via the material ribbon with rollers 36 of the upper sling carriage 37.

The ribbon, coming from the wind-off reel, runs into the sling tower, passes through the sling tower, whereby the guide rollers 32 and 33 are alternately looped, and leaves the tower at the last guide roller 32, whereupon the ribbon-processing operation follows.

As the ribbon is being exchanged at the wind-off reel, the sling carriage 34 with guide rollers 33 moves downwards and transfers the stored supply of ribbon to the subsequent ribbon-processing equipment. The rise and fall of the sling carriage is effected by a chain drive 38, which is driven by a conventional direct-current motor (not shown), whereby the transport of ribbon material at a constant rate is controlled by a guide roller 35 that is fashioned as a traction dynamometer roller.

During a subsequent exchange of ribbon at the winding-up reel or during an inspection of the ribbon, upper sling carriage 37 with guide rollers 36 moves downward and stores ribbon coming from the ribbon processing equipment. After the exchange of ribbon at the wind-up reel has been concluded or the inspection has been carried out, sling carriage 37 again drives to the starting position and transfers the supply of ribbon, so stored, to the wind-up reel. Sling carriage 37 is transported over a separate chain drive with direct-current drive, for which one guide roller 35 is fashioned as a traction dynamometer roller. Shortly before the next ribbon exchange takes place at the wind-off reel tower sling carriage 34 drives back to its starting position and stores a supply of ribbon for the next ribbon exchange.

Figure 5:
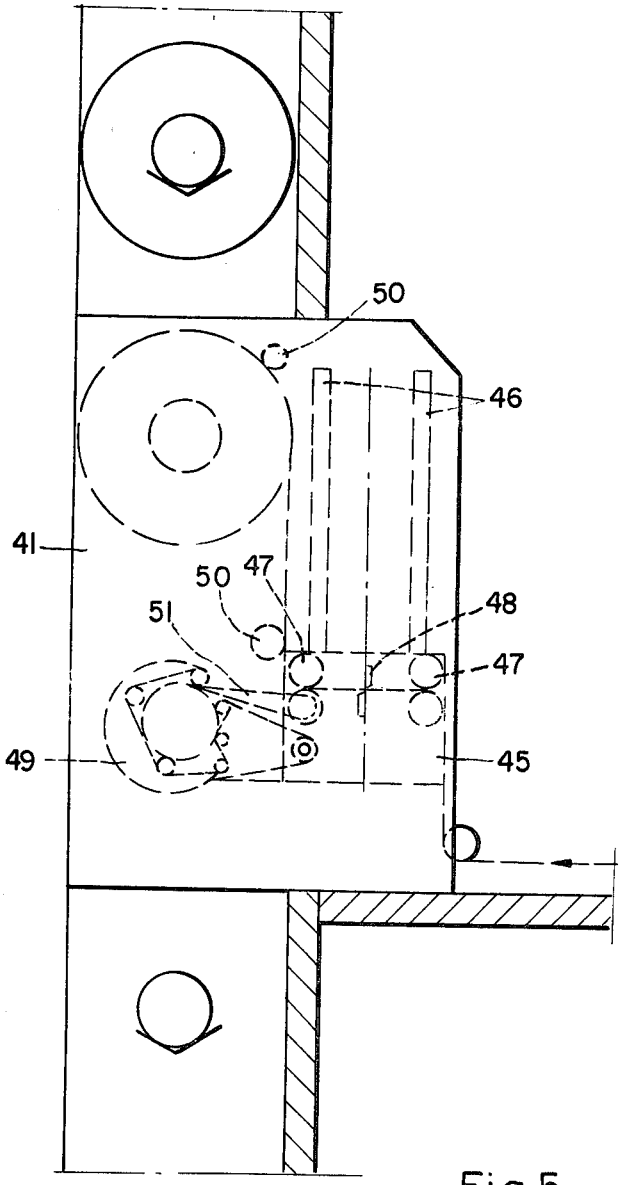
FIG. 5 is a side view, on an enlarged scale, of the double wind-up reel of the equipment of FIG. 1.
Figure 6:
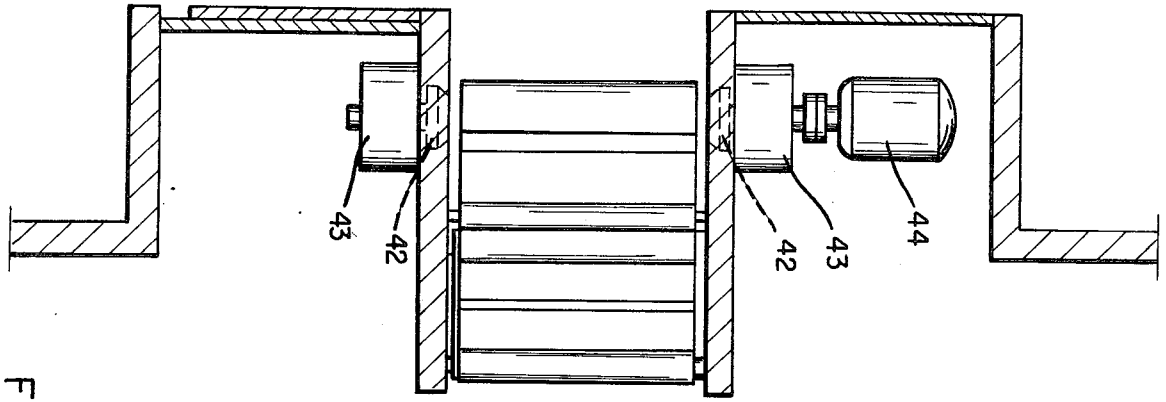
FIG. 6 is a section, on an enlarged scale, taken through the double wind-up reel of FIG. 2, showing it in detail as seen from above.

FIGS. 5 and 6 show details of the double wind-up reel of the inventive equipment.

FIG. 5 represents the front view and FIG. 6 a top view section through the reel. The side stands 41 (FIG. 5), which take up the gripping cones 42 (FIG. 6) and their guides 43 (FIG. 6), are a part of the support wall in the high-shelf magazine. The reel is driven by a direct-current motor 44 (FIG. 6), which can be connected selectively to one or the other of the wind-up spindles. A ribbon-exchange carriage 45 (FIG. 5) belongs to the wind-up reel. This carriage can drive hydraulically from one wind-up position to the other and is guided by guide rails (FIG. 5) on the side stand. Two sets of drivers 47 (FIG. 5), one pair of cropping shears 48 and a belt looper 49, are mounted in the ribbon exchange carriage. The cropping shears and the belt looper are hydraulically activated, the drive rollers are driven by a conventional three-phase geared motor. During normal winding operation, the drive rollers 47 serve as guide rollers. During ribbon exchange, the ribbon exchange carriage 45 drives into position, the drive rollers 47 which are equipped with a flyback suppressor (not shown) clamp the ribbon and the cropping shears 48 cut off the end of the ribbon. The cut off end of the ribbon is wound onto the spool that has already been wound up and glued to the spool by means of back-up roller 50 (FIG. 5) with adhesive-tape dispenser.

The belt looper 49 swings out and loops around the empty wind-up casing. The drive rollers 47 then push the start of the ribbon over the trap-door lock 51 towards the belt looper 49. After the wind-up casing has been lopoped with a few windings of ribbon material, the belt looper opens up and swings out of the area of winding. The drive rollers 47 open up and the ribbon exchange-carriage 45 drives into its waiting position between the two winding positions.

Although a specific embodiment of the invention has been disclosed for illustrative purposes, it will be appreciated by those skilled in the art that many additions, modifications and substitutions are possible without departing from the scope and spirit of the invention as defined in the accompanying claims.

What is claimed is:

1. Apparatus for automatically joining the beginning of a first spool of metal ribbon to the end of a second spool of metal ribbon which is being unwound and fed to a processing device without halting the passage of ribbon through said processing device, which apparatus comprises:

means for holding said first and second spools in rotatable relationship to one another;

at least one wind-up spool for receiving ribbon which has unwound from said second spool, and passed through said processing device;

means for clamping, severing and joining the beginning end of said first spool of ribbon to the severed end of said second spool of ribbon; and a storage apparatus comprising:

a frame;

a first row of aligned freely rotatable rollers mounted in a fixed position on said frame, and a second row of aligned freely rotatable rollers mounted in a fixed position on said frame opposite said first row of rollers, a first carriage having a first movable row of rotatable rollers mounted in alignment thereon, said first carriage being mounted between said first and second rows of fixed rollers for displacement relative thereto, a second carriage having a second movable row of rotatable rollers mounted in alignment thereon, said second carriage being mounted between said first and second rows of fixed rollers for displacement relative thereto, said ribbon from said second spool alternately passing over rollers of said second fixed row and said second movable row en route to said processing device and alternately passing over rollers of said first fixed row and said first movable row en route from said processing device to said wind-up spool, said second movable row of rollers being spaced by a predetermined distance from said second fixed row of rollers when said second row is rotating and feeding ribbon through said processing stage, and operating means for moving said movable rows of rollers, said second movable row of rollers being moved away from said second fixed row of rollers to create an elongated storage path between said movable and fixed rollers for said ribbon and allowing said processing device to operate on ribbon from said second reel while said wind-up reel is changed.

2. A system according to claim 1 wherein said first and second carriages are provided with separate driving means to effect displacement thereof.

3. A system according to claim 1 further including a wind-off reel for receiving said first and second spools, a wind-up reel for receiving said at least one wind-up spool, said wind-off and wind-up reels being mounted in alignment on a shelf structure defining a magazine for a plurality of spools, and a spool transport device adapted for movement along a path at least a portion of which extends between said reels, said transport device being capable of carrying spools between said reels and said magazine.

4. In an improved system for continuously processing sheet material from containing means adapted to hold a predetermined amount of said material, said system including dispensing means including a plurality of said containing means which are alternately emptied and replaced with a full containing means by joining the end of material from one containing means to the beginning of the material from the next emptied containing means so that a continuous sheet of material is formed, a processing station adapted to receive said continuous sheet of material from said dispensing means for performing a predefined process thereon to produce a continuous processed sheet, collecting means adapted to receive said processed sheet and including a plurality of said containing means which are alternately filled with processed sheet material and replaced with an empty containing means by severing the processed sheet as each containing means is filled so that containing means filled with processed material are formed, wherein the improvement comprises buffer means comprising:

a frame;

first and second confronting rows of aligned, freely rotatable rollers mounted in a fixed, spaced relationship on said frame;

first and second carriages each having a row of aligned, rotatable rollers, said first and second carriages being mounted between said first and second fixed rows of rollers for displacement relative thereto;

said continuous sheet of material being alternately looped between said first fixed row of rollers and said first carriage rollers which cooperate to define a first component for normally storing a predetermined amount of said continuous sheet of material while continuously transporting said material to said processing station, said first component being actuable to give up at least a portion of said predetermined amount of said continuous sheet while material from successively empty containing means is joined, said predetermined amount being at least equal to the amount of sheet material which would be dispensed during the interval required for said joining;

said continuous processed sheet being alternately looped between said second fixed row of rollers and said second carriage rollers which cooperate to define a second component actuable to store a set amount of said continuous processed sheet while it is being severed and transferred from a filled containing means to the succeeding empty one, said set amount of processed material being given up to said empty containing means after filling thereof begins;

each of said components effecting storage of material by separating the corresponding carriage rollers and fixed row of rollers and giving up material by bringing the same together;

said buffer means permitting continuous dispensing from different containing means, continuous processing of material, and continuous filling of containing means with processed material without requiring stopping or slowing the operation of said system.

5. A system according to claim 4 wherein said first and second carriages are provided with separate driving means to effect displacement thereof.

6. A system according to claim 4 wherein said containing means are spools, said dispensing and collecting means being multiple reels each including a plurality of spools and being mounted in alignment on a shelf structure defining a magazine for a plurality of spools, and a spool transport device adapted for movement along a path at least a portion of which extends between said reels, said transport device being capable of carrying spools between said reels and said magazine.

* * * * *